US005180607A

United States Patent [19]

Umise et al.

[11] Patent Number: 5,180,607

[45] Date of Patent: Jan. 19, 1993

[54] METHOD OF MANUFACTURING STRIPS OF THERMAL TRANSFER RECORDING SHEETS

[75] Inventors: Shigeki Umise, Kawaguchi; Hirokatsu Imamura, Nerima, both of Japan

[73] Assignee: Dai Nippon Insatsu Kabushiki Kaisha, Japan

[21] Appl. No.: 841,513

[22] Filed: Feb. 26, 1992

Related U.S. Application Data

[60] Continuation of Ser. No. 614,212, Nov. 15, 1990, Pat. No. 5,109,795, which is a division of Ser. No. 265,679, filed as PCT/JP88/00189 on Feb. 23, 1988, now Pat. No. 4,985,292.

[30] Foreign Application Priority Data

Feb. 23, 1987 [JP] Japan ..... 62-25204
Sep. 26, 1987 [JP] Japan ..... 62-239939

[51] Int. Cl.[5] ..... B41M 3/12; B05D 3/12

[52] U.S. Cl. ..... 427/8; 427/146; 427/150; 427/177; 427/179; 427/84; 427/285; 427/286; 427/288

[58] Field of Search ..... 427/150, 179, 177, 289, 427/288, 286, 285, 146, 153, 8

[56] References Cited

U.S. PATENT DOCUMENTS

| | | | |
|---|---|---|---|
| 2,379,495 | 7/1945 | Roesen | 118/672 |
| 2,573,097 | 10/1951 | Epstein | 118/672 |
| 2,839,025 | 6/1958 | Burke et al. | 118/642 |
| 4,643,130 | 2/1987 | Sheath et al. | 118/212 |
| 4,670,307 | 6/1987 | Onishi et al. | 427/288 |
| 4,720,480 | 1/1988 | Ito et al. | 503/227 |

FOREIGN PATENT DOCUMENTS

| | | | |
|---|---|---|---|
| 48-27364 | 8/1973 | Japan | 503/227 |
| 56-155794 | 12/1981 | Japan | 503/227 |
| 57-69093 | 4/1982 | Japan | 503/227 |
| 58-24495 | 2/1983 | Japan | 503/227 |
| 60-179257 | 9/1985 | Japan | 503/227 |
| 60-255439 | 12/1985 | Japan | 503/227 |

*Primary Examiner*—Janyce Bell
*Attorney, Agent, or Firm*—Parkhurst, Wendel & Rossi

[57] ABSTRACT

A strip or roll of thermal transfer type recording sheet has a base film on one side of which a hot-melt ink layer is formed for recording on paper or other surface by thermal transfer. An end mark or marks to be detected optically for warning the user of the fact that the recording roll is being used up is/are formed adjacent one end of the strip by gravure printing with use of a light-reflective ink. The end mark or marks produced by gravure printing are of such constant thickness, and with the bounding edges so sharply defined, that they permit positive detection by an optical sensor.

For the production of the end marks by gravure printing, a web of base film with the hot-melt ink layer formed on one side thereof, with a width several times greater than that of each strip of recording sheet to be manufactured, is fed through a printing unit of a gravure printing section. A set of end marks printed by the printing unit on the web in juxtaposition in its transverse direction are dried immediately, with the drying effect exerted only on the end marks. Then, while being still fed continuously, the web is slit at a slitting section into the required narrower strips of recording sheet each bearing one of the end marks. The separate strips of recording sheet are subsequently wound into rolls.

6 Claims, 6 Drawing Sheets

METHOD OF MANUFACTURING STRIPS OF THERMAL TRANSFER RECORDING SHEETS

This application is a Rule 60 continuation application of Ser. No. 07/614,212, filed Nov. 15, 1990, now U.S. Pat. No. 5,109,795, which in turn is a Rule 60 divisional application of Ser. No. 07/265,679, filed as PCT/JP88/00189 on Feb. 23, 1988, now U.S. Pat. No. 4,985,292.

TECHNICAL FIELD

This invention relates to thermal transfer type recording sheets or strips of roll form which are used with, typically, heat-sensitive facsimile recorders, and to an apparatus for the manufacture of such recording sheets. More specifically, the invention pertains to a strip or roll of thermal transfer type recording sheet bearing an end mark for enabling the detection of the fact that the strip or roll is drawing to its end in use, as well as to an apparatus including means for printing such an end mark in a preassigned position on the recording sheet.

BACKGROUND ART

The facsimile recorder has been known and used extensively which employs a roll of thermal transfer type recording sheet, known as a donor roll, through which the subject copy is thermally transferred to paper. Some facsimile recorders on the market are further equipped to detect the fact that the roll is being used up, and to visually or audibly forewarn the user of the end of the roll.

In order to make possible the automatic detection of the fact that the recording sheet is coming near to its end, it has been practiced to provide an end mark having a reflective surface on the sheet, in a position spaced a prescribed distance from its end anchored to the roll shaft. The end mark may be formed either directly on one side of the base film of the recording sheet or on the hot-melt ink layer on the other side of the base film. The end mark is optically detected by a sensor comprising a source of infrared radiation and a photodetector responsive to such radiation. Flexography and brushing represent two typical conventional measures for creating such end marks.

Such conventional methods of forming end marks are objectionable for several reasons. First, for flexographic production of end marks, the printing ink of reflective material is pressed against the recording sheet by a rubber-made relief plate. The recording sheet is so thin, however, that the relief plate tends to wrinkle the sheet when pressed against the same via the reflective material. At the same time, moreover, the reflective ink easily oozes out from between the recording sheet and the plate, thereby forming undesired bulges beyond the due boundaries of the end marks. Such bulges not only blur the bounding edges of the end marks but also make their thickness uneven.

Additional disadvantages of flexography arise from the fact that before printing, the reflective ink on the rubber plate is in the form of a film overlying the protuberant parts of the relief plate. The ink film tends to develope unevenness on its transfer from the plate to the recording sheet, and it is difficult to control the amount of the ink so transferred and, therefore, the thickness of the end mark so printed. The composition of the ink is also subject to the restriction that it should contain no such solvent as will attack the rubber plate.

This restriction imposes additional limitations on the choice of resins to be contained in the ink as a binder. Accordingly, the desired dispersion characteristics of the pigment or powdered metal contained in the ink are not easy to realize, with a consequent decrease in the quality of the printings. It is a still further weakness of flexography that the rubber plates are susceptible to deformation and poor in durability.

The production of end marks by brushing is also objectionable because of the poor quality of the markings so produced. What is worse, this conventional method is very time-consuming and not suitable for mechanized production of the recording sheets on a large scale.

For the reasons set forth in the foregoing, the end marks produced in accordance with the prior art, either by flexography or by brushing, have often been of uneven thickness and have not been defined clearly enough. Such defective end marks have often invited misdetection by infrared sensors, with the result that no warning is generated at the required time before the roll of recording sheet is used up.

Known apparatuses for the manufacture of rolls of recording sheets with end marks thereon have also had difficulties in connection with the application of end marks. Heretofore, the end marks have been formed off-line in longitudinally spaced groups on a continuous web of base film with a hot-melt ink layer thereon. The web has a width several times greater than that of each strip of recording sheet to be produced, and each group of end marks are arranged side by side in the transverse direction of the web. Then, by a separate apparatus, the web has been slit longitudinally into the required narrower strips of recording each bearing an end mark thereon.

An objection to this conventional method of manufacture is that if the end-marked web wrinkles or developes other defects while being slit, one roll length of the web has to be discarded. Another weakness is the inefficiency of production due to the fact that the application of end marks to the web and the slitting of the end-marked web require separate machines totally disconnected from each other.

Accordingly, it is an object of the invention to provide a roll or strip of thermal transfer type recording sheet having an end mark so formed as to assure infallible detection by an optical sensor in order to warn the user of the approaching end of the strip.

Another object of the invention is to provide an apparatus for efficient manufacture of such a roll or strip of recording sheet having the end mark.

SUMMARY OF THE INVENTION

The thermal transfer type recording sheet in accordance with the invention has a strip of base film with a hot-melt ink layer formed on one side thereof. An end mark is formed on either side of the recording sheet at least in a preassigned position spaced a prescribed distance from that end of the recording sheet which is attached to a roll shaft for rolling up the recording sheet thereon. In order to enable accurate detection by an optical sensor, the end mark is formed by gravure printing with use of an ink that reflects light.

Thus the invention teaches the gravure printing of reflective end marks. As is well known, gravure printing is such that the ink which has been contained in a multiplicity of ink cells or minute depressions in the surface of the gravure printing plate is transferred to a printing surface (in this case, to either of the opposite surfaces of the recording sheet) in the form of fine dots. Gravure printing offers the definite advantage over flexography that the ink is not susceptible to flow on the recording sheet surface when transferred from the cells in the plate. The capacities of the ink cells determine the amount of the ink to be printed and, in consequence, the thickness of the printing. It is therefore easy to create extremely thin end marks of constant thickness. The boundaries of the end marks will be sharply defined since there will be no oozing of the ink beyond the bounding edges. Such end marks are, of course, accurately detectable by optical sensors of conventional design, making possible the timely change of the donor rolls. Gravure printing provides the additional advantage of permitting the use of practically any ink, so that the invention totally overcomes the noted difficulties heretofore encountered with flexographic printing of end marks.

The invention also provides an apparatus for the manufacture of the above described thermal transfer type recording sheet, comprising web supply means for continuously supplying a web having an elongate strip of base film with a hot-melt ink layer formed on one side thereof, feed means for continuously feeding the web from the web supply means, gravure printing means for forming a set of end marks on either surface of the web being fed by the feed means, the set of end marks being spaced from one another in the transverse direction of the web, actuating means for actuating the gravure printing means for causing the same to form the end marks in preassigned longitudinal positions on the web, and slitting means for longitudinally slitting the web into a plurality of strips of thermal transfer type recording sheet each being one of the end marks.

It should be appreciated in connection with the above disclosed apparatus of the invention that the gravure printing of the end marks on the web and the slitting of the end marked web are performed in one and the same apparatus while the web is being fed continuously therethrough. The efficiency of production is thus materially enhanced in comparison with the conventional case wherein the printing of the end marks and the slitting of the web have been effected in separate devices. As a further advantage, even if the web wrinkles or suffers some other defect while being slit, only the defective part of the web may be removed, so that the waste of the web can be reduced to a minimum.

DETAILED DESCRIPTION OF THE INVENTION

Figure 1:
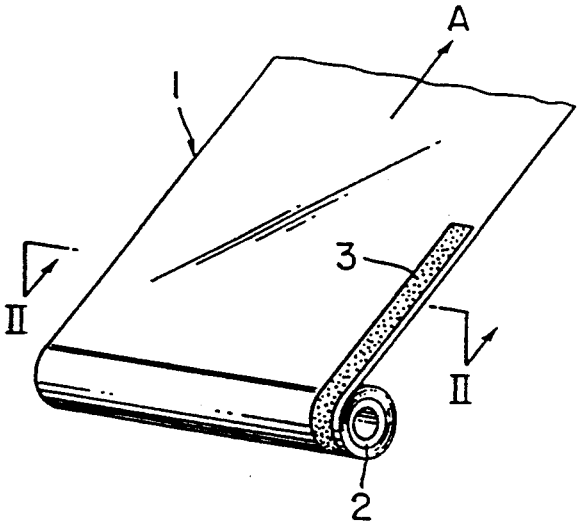
FIG. 1 is a partial perspective view of the thermal transfer type recording sheet in accordance with the invention, the recording sheet being shown in roll form and with an end mark formed thereon.

The invention is shown in FIG. 1 as embodied in a thermal transfer type recording sheet 1 of roll form. Wound on a roll shaft 2, the continuous strip of recording sheet 1 is shown pulled off therefrom in the direction of the arrow A to such an extent that a relatively small length of the strip is left on the roll shaft.

Figure 2:
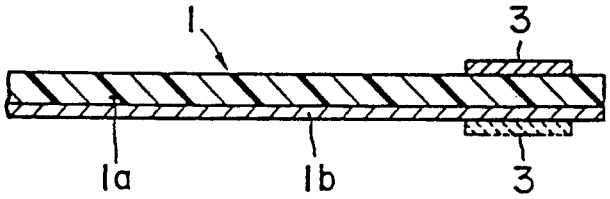
FIG. 2 is an enlarged cross sectional view of the recording sheet taken along the line II—II in FIG. 1.

As illustrated cross-sectionally in FIG. 2, which is taken along the line II—II in FIG. 1, the recording sheet 1 has a base film 1*a* on one side of which there is formed a layer 1*b* of hot-melt ink for the recording of the subject copy by thermal transfer. The base film 1*a* can be fabricated from such plastics as polyester, polypropylene, cellophane, acetate and polycarbonate, as well as from papers such as condenser paper and paraffin paper. Polyester film is recommended. The hot-melt ink layer 1*b* can be conventionally compounded primarily of a pigment, thermoplastic resin, and waxes. The heat-soluble ink may be applied to a thickness of three to eight microns for unfailing production of high quality markings.

As has been known heretofore, the recording sheet 1 is intended for use in the form of a roll on the roll shaft 2. Unrolled from the roll shaft 2, the recording sheet 1 is to have its hot-melt ink layer 1*b* held against a desired surface so as to permit thermal transferred thereto under the action of a thermal head. The recording sheet 1 will be gradually unwound from the roll shaft 2 with the progress of such recording, until an end mark 3 becomes revealed as shown in FIG. 1. Designed to enable the detection of the approaching end of the recording sheet, the end mark 3 is herein shown as a narrow strip extending alongside a longitudinal edge of the recording sheet 1 to a relatively short length in a position spaced a prescribed distance from the end of the recording sheet which is anchored to the roll shaft 2. FIG. 1 shows the end mark 3 formed on that side of the recording sheet 1 which is opposite to the side where the hot-melt ink layer 1*b* is formed. Alternatively, however, the end mark may be formed on the ink layer 1*b*, as indicated by the dashed lines in FIG. 2, without the risk of interfering with recording.

The end mark 3 takes the form of a light-reflective layer formed by gravure printing to a thickness of one to six microns in accordance with the invention. The ink for use in the gravure printing of the end mark 2 should preferably be silver or gold in color for optimum reflectivity. Such a silver- or gold-colored end mark will favorably shield the underlying base film 1*a* or hot-melt ink layer 1*b*, which may be black in color, and will provide a markedly reflective surface against the dark background.

Gravure printing inks suitable for the provision of the silver- or gold-colored reflective layer may contain metal such as aluminum in finely divided form. Such metal particles tend to settle during the storage or use of the inks, so that a white pigment may be added as required to minimize the settling tendency. The following is a list of some specific examples of gravure printing inks that may be employed for the provision of the light-reflective layer:

| Gravure printing ink 1: | |
|---|---|
| Aluminum paste | 13 parts |
| "VA-HR430" (tradename) | 87 parts |
| The composition of the "VA-HR430" is: | |
| Vinylidene fluoride | 8.7 parts |
| Carbon fluoride | 6.5 parts |
| Methyl ethyl ketone | 47.0 parts |
| Toluene | 9.6 parts |
| "M-AT BC-TF" (tradename) | 21.7 parts |
| "M-AT Mark FC113" (tradename) | 6.5 parts |

The "M-AT BC-TF" is compounded of 10 parts Teflon (polytetrafluoroethylene) (trademark) powder, 40 parts acrylic polyol, 30 parts methyl ethyl ketone, and 20 parts of additives. The "M-AT Mark FC113" is compounded of 30 parts graft polymer wax, 65 parts toluene, and five parts ethyl acetate.

| Gravure printing ink 2: | |
|---|---|
| Aluminum paste | 8.0 parts |
| Nitrocellulose | 16.5 parts |
| Rosin ester | 3.0 parts |
| Wax | 4.5 parts |
| Castor oil | 3.0 parts |
| Dioctyl malate | 3.0 parts |
| Toluene | 20.0 parts |
| Isopropyl alcohol | 14.0 parts |
| Ethyl acetate | 28.0 parts |

| Gravure printing ink 3: | |
|---|---|
| Gravure printing ink 2 | 64.0 parts |
| "CM 950 White" (tradename) | 36.0 parts |

The "CM 950 White" is composed primarily of 24.0 parts titanium oxide, 26.0 parts varnish, and 14.0 parts wax.

White gravure printing inks such as those containing titanium white might be employed for the reflective layer. An objection to such white printing inks, however, is that they tend to invite errors in detection by reason of variable degrees of whiteness and, in consequence, of reflection offered thereby. Silver or gold inks are preferable from the standpoint of greater accuracy of detection.

The creation of the reflective layer constituting the end mark 3 by gravure printing offers some definite advantages. First, at the time of printing, the ink that has been contained in a multiplicity of minute ink cells on the surface of the gravure printing plate is transferred to the base film 1*a* or to the heat-soluble ink layer 1*b* in the form of fine dots or invariably minimal thickness. So formed, the end mark 3 as a whole is, of course, of minimal, constant thickness, with its bounding edges very sharply defined to close dimensional tolerances. Such an end mark will be positively detected by an optical sensor. The close dimensional tolerances of the end mark make it possible to increase its size (in this case, width) to the maximum determined by the relative positional accuracy of the end mark and the associated infrared sensor. A further advantage of gravure printing is that, unlike flexography or other types of letterpress, it will not wrinkle the recording sheet no matter how thin it may be. Furthermore, since gravure printing lends itself to use with a greater variety of inks than other printing processes, there may be employed inks of the highest possible reflectivity with respect to infrared rays.

Preferably, in the use of a plastic base film for the recording sheet 1, an additional layer for preventing the sticking of the recording sheet to the thermal head may be formed on that side of the recording sheet which will come into contact with the thermal head.

Figure 3:
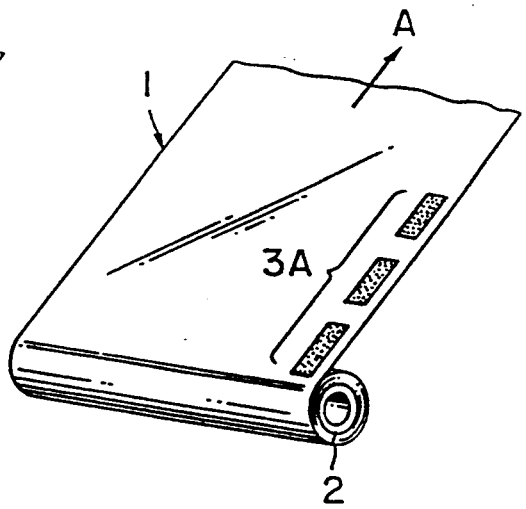
FIG. 3 is a view similar to FIG. 1 but showing an alternative form of recording sheet in accordance with the invention.

As desired, a second end mark may be formed on the recording sheet 1 in a position farther away from its end attached to the roll shaft 2 than the first end mark 3, as indicated by way of example at 3A in FIG. 3. The second end mark 3A is herein shown as a series of relatively short strips formed by gravure printing like the first end mark 3. The second end mark 3A is intended to serve the purpose of forewarning the approach of the end of the recording sheet 1, before the first end mark 3 is detected for warning the fact that the remaining length of the recording sheet is so little as to warrant the installment of a new roll.

Figure 4:
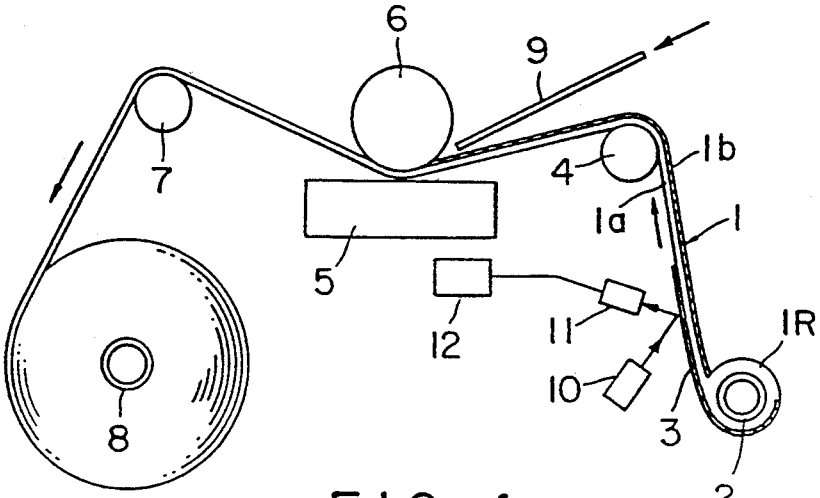
FIG. 4 is a diagrammatic representation of a mode of use of the recording sheet in accordance with the invention, the figure being particularly explanatory of the way in which the end mark on the recording sheet is optically detected.

FIG. 4 is explanatory of a mode of use of the thermal transfer type recording sheet 1. Pulled from a supply roll 1R on the roll shaft 2, the continuous strip of recording sheet 1 travels in the arrow-marked direction over a guide roll 4, then between a thermal head 5 and a backup roll 6, and then over another guide roll 7, to be wound up on a takeup roll shaft 8.

A sheet of paper 9 to be recorded, on the other hand, is fed from a paper supply tray, not shown, and placed against the recording sheet 1. The subject copy is thermally recorded on the paper 9 via the recording sheet 1 as they travel in contact with each other between the thermal head 5 and the backup roll 6.

The end mark 3 in the form of a reflective strip will appear as shown in FIG. 1 when the recording sheet 1 draws near the end on the supply roll shaft 2. As pictured in FIG. 4, the end mark 3 so revealed will come opposite an infrared sensor comprising a light source 10 and a photodetector 11. Emitted from the light source 10, the infrared rays will impinge on the end mark 3 thereby to be reflected toward the photodetector 11. Thus the infrared sensor detects the fact that the recording sheet 1 is being used up. An alarm 12 is shown connected to the photodetector 11 for warning the approach of the end of the recording sheet 1 upon detection of the end mark 3.

As is clear from the foregoing, the thermal transfer type recording sheet in accordance with the invention makes it possible to infallibly ascertain the approach of its end on the supply roll shaft when used with a conventional heat-sensitive recording device equipped with an infrared sensor. A new roll of recording sheet may be readily loaded in the recording device when the old roll is used up.

It has been stated that the end mark formed as taught by the invention is of constant thickness, with its entire surface offering an unvarying degree of reflectivity. This feature gains the following advantage. The thermal transfer recording sheet in general unavoidably flutters during its travel from supply roll to takeup roll, and the hot-melt ink layer of the recording sheet is not necessarily of constant thickness. For these reasons the reflected infrared rays inevitably contain some noise. Some conventional thermal transfer recording devices have been designed to detect the end mark in the face of some such noise contained in the reflected light. These known devices may fail to detect an end mark of irregular reflectivity because the infrared rays reflected by such an end mark may include a noise component similar to that contained in the light reflected from the other surface of the recording sheet. It is therefore apparent that the end mark of unvarying thickness and reflectivity in accordance with the invention serves to eliminate such malfunctioning of the known recording devices.

An apparatus for the manufacture of the above thermal transfer type recording sheet will now be described with reference to FIGS. 5–11.

Figure 5:
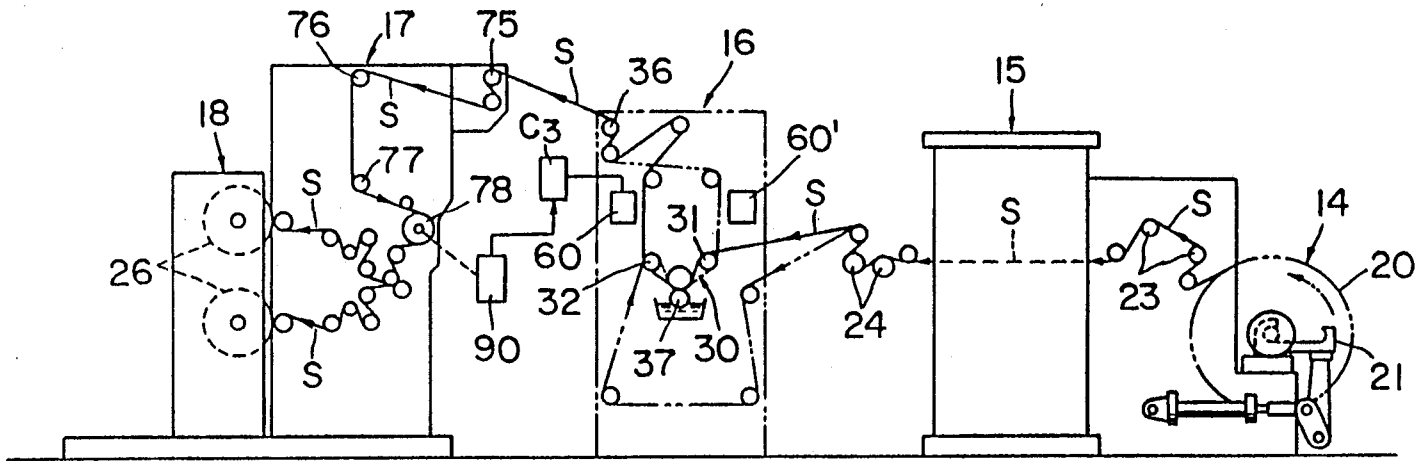
FIG. 5 is a diagrammatic side elevation of the apparatus for the manufacture of the recording sheet in accordance with the invention.

As will be seen from FIG. 5, the apparatus broadly comprises a web supply section 14, a leader tape splicing section 15, a gravure end mark printing section 16, a slitting section 17, and a recording sheet winding section 18.

The web fed from the supply section 14 is equivalent in construction to the recording sheet 1, having the base film 1*a* with a coating 1*b* of hot-melt ink preformed on one side thereof, except that the end mark 3 is absent and that the web is two or more times wider, and many times longer, than each roll of recording sheet 1 to be manufactured. FIG. 5 shows that the web is supported in the form of a roll 20 on a roll support 21 of the web supply section 14. As indicated at S in the same figure, the web is guided by a series of guide rolls 23 from the supply section 14 to the leader tape splicing section 15. In this splicing section 15 the web is transversely cut into successive lengths each equal to that of each roll of recording sheet to be manufactured, and tapes of the same width as the web are spliced to the leading and trailing ends of each length of the web S for the ease of subsequent handling. As desired however, the tape may be spliced only to the trailing end of each severed length of the web S.

Then, guided by another series of guide rolls 24, the web S is directed to the gravure printing section 16, where a group of end marks 3, each shown in FIGS. 1 and 2, are printed on each length of the web in juxtaposition in its transverse direction. The second end marks 3A, FIG. 3, may or may not be printed on the web at this gravure printing section 16.

Following the printing of the end marks 3, together with or without the second end marks 3A, the web S travels on to the slitting section 17, where the broad web is longitudinally slit into a plurality of narrower strips of thermal transfer type recording sheet each constructed as in FIGS. 1 and 2. Then the individual strips of recording sheet are wound onto rolls 26 at the winding section 18.

The aforesaid series of guide rolls 23 and 24 and many other rolls provided subsequently, constitute in combination feed means for continuously feeding the web through the apparatus.

The web supply section 14 and the leader tape splicing section 15 can be of conventional or any suitable construction and thus form no features of the invention. Only the gravure printing section 16 and slitting section 17 of the illustrated apparatus will therefore be described in greater detail hereafter.

Figure 6:
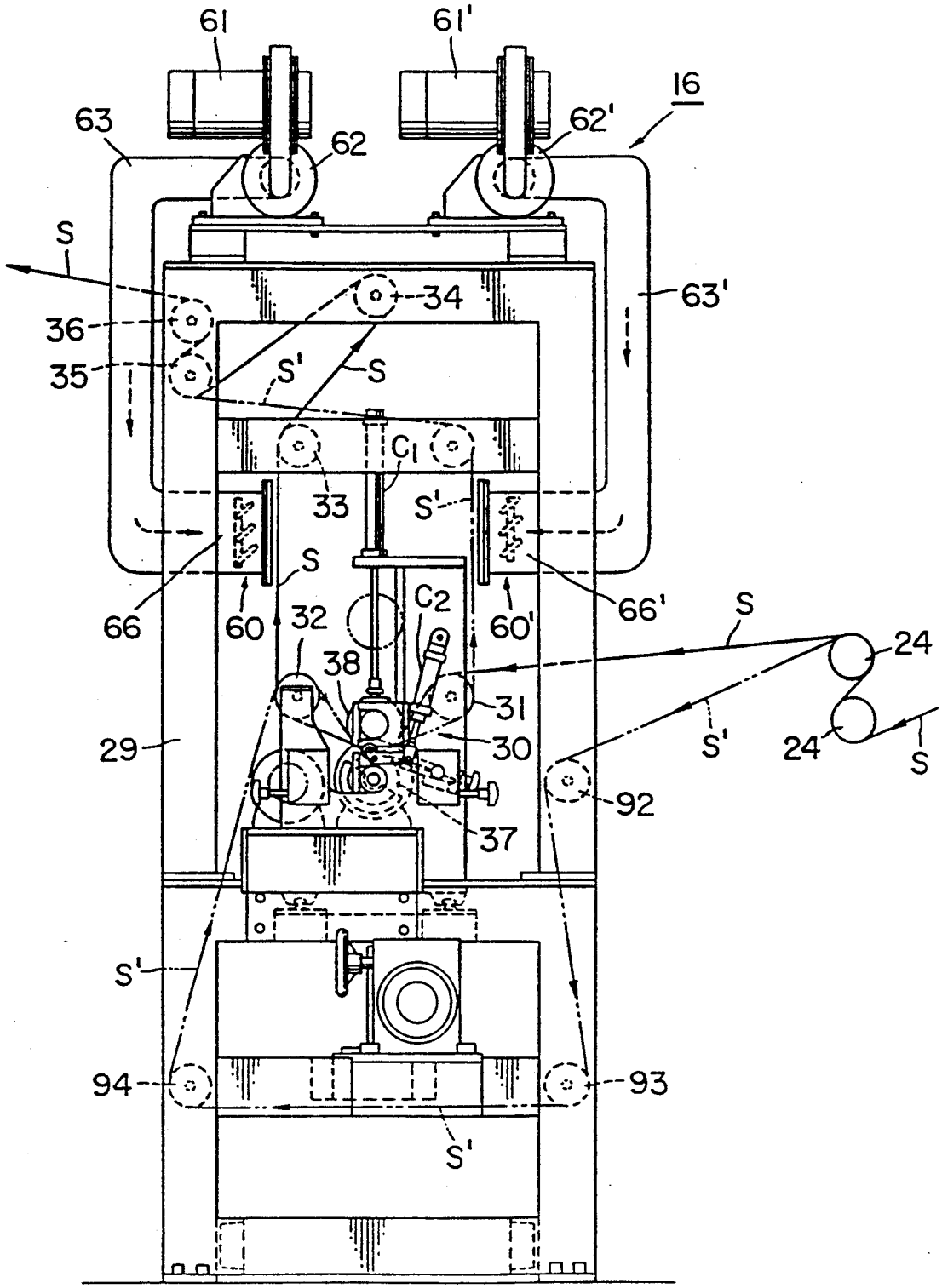
FIG. 6 is an enlarged side elevation of the gravure printing section of the apparatus of FIG. 5.

FIG. 6 shows the details of the gravure printing section 16 on an enlarged scale. The gravure printing section 16 has a framework 29 having a gravure printing unit 30 mounted therein. The web S is fed to this printing unit 30 via the noted series of guide rolls 24 and another guide roll 31. On the downstream side of the printing unit 30 the web S is directed upwardly and away from the printing section 16 via guide rolls 32, 33, 34, 35 and 36.

Figure 7:
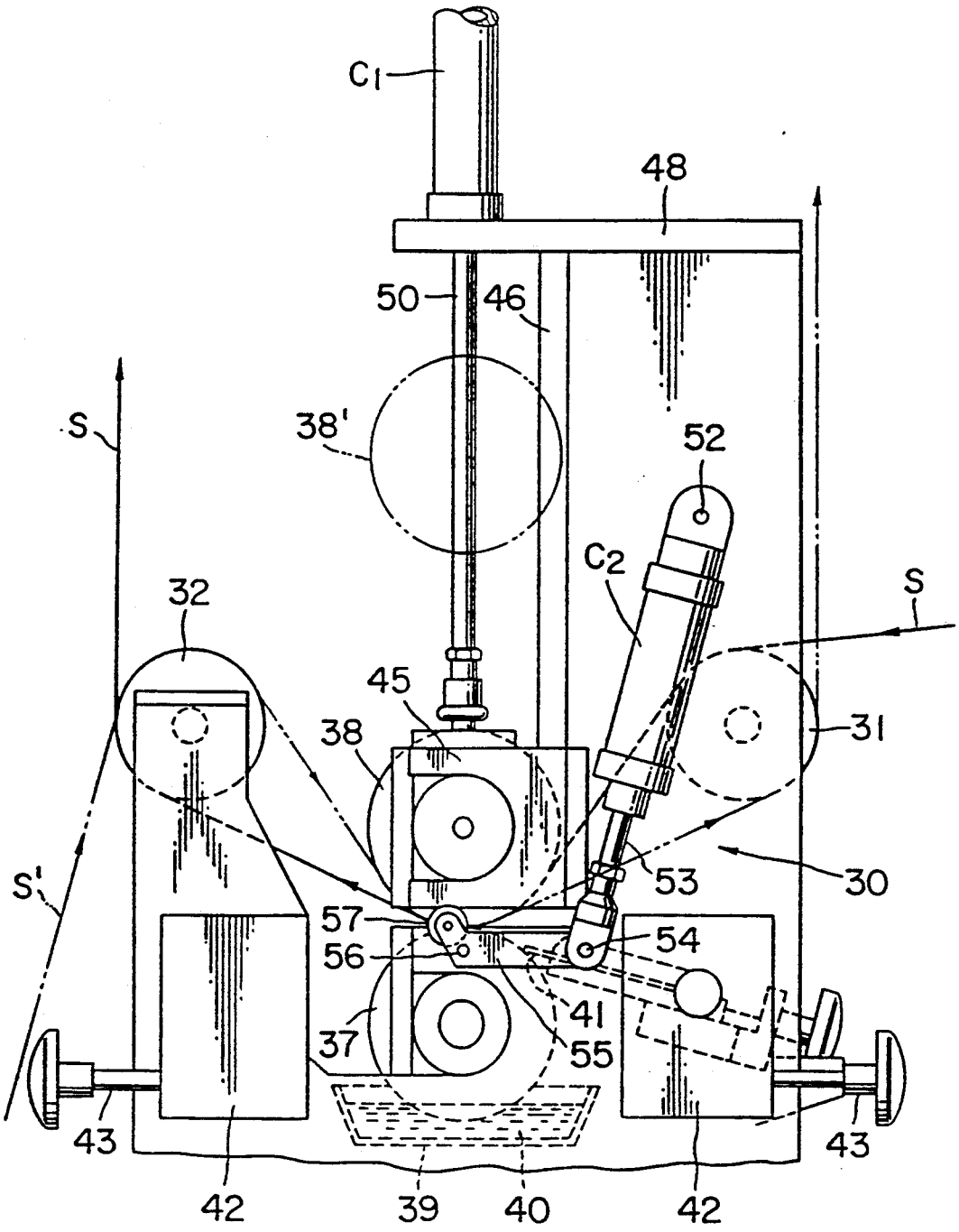
FIG. 7 is a still more enlarged side elevation of some parts of the gravure printing section shown in FIG. 6.

FIG. 7 is a detailed representation, on a still more enlarged scale, of the printing unit 30. It comprises a plate cylinder 37, an impression cylinder 38 thereover, and an ink pan 39 underlying the plate cylinder. The ink pan 39 is shown to contain gravure printing ink 40 in which the plate cylinder 37 is partly dipped. It is understood that the plate cylinder 37 has formed therein a multiplicity of gravure ink cells patterned to print the desired end marks on the web S. Provided on both sides of the plate cylinder 37 are a pair of doctor blade mounts 42 each supporting a doctor blade 41 for scraping an excess amount of ink off the surface of the plate cylinder 37. These doctor blade mounts have each a doctor blade adjustment knob 43 to be manipulated for fine adjustment of the associated doctor blade 41 with respect to the plate surface of the cylinder 37. Only either of the two doctor blades 41 is actually used for printing, as will be later explained in more detail.

Figure 8:
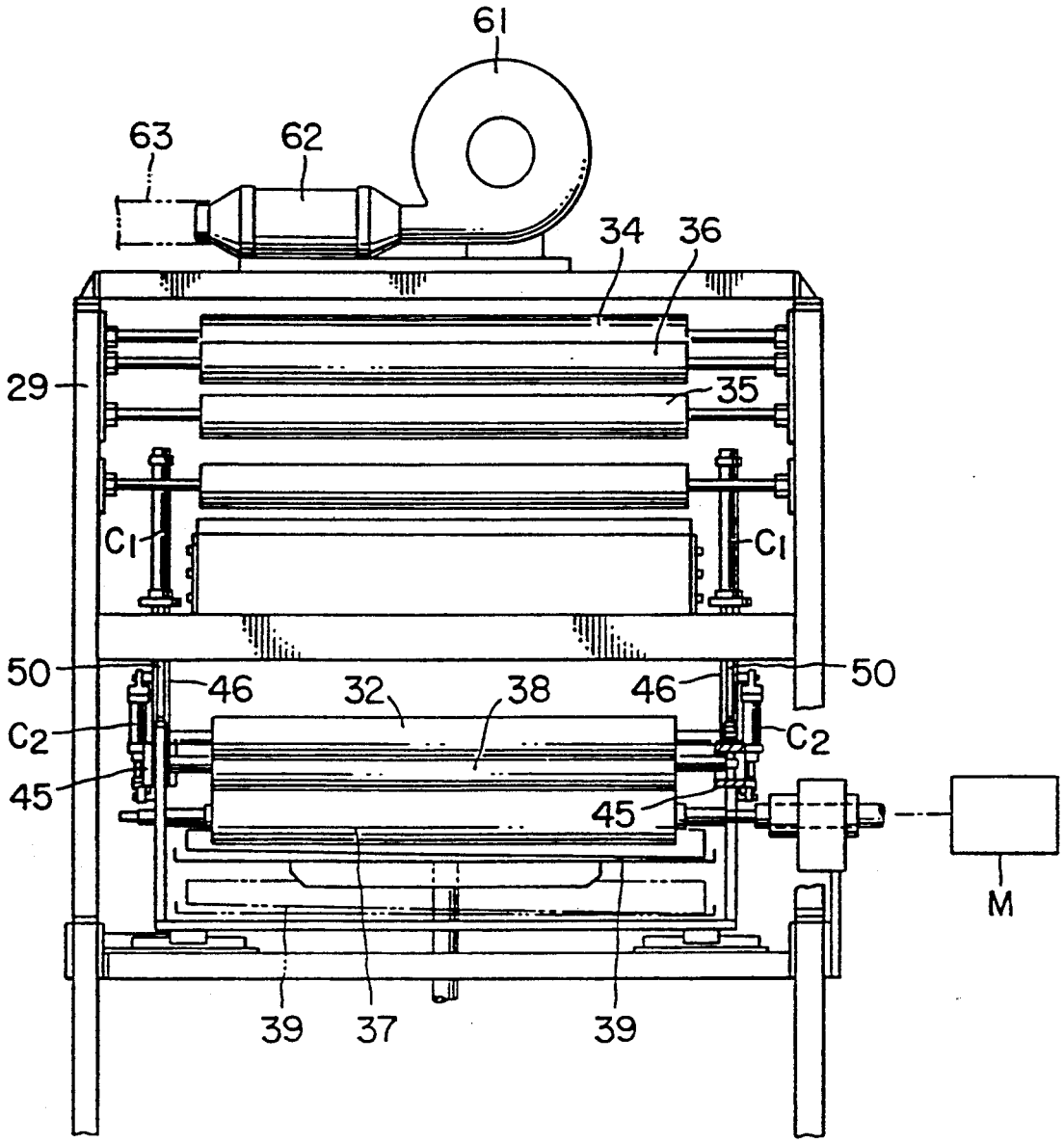
FIG. 8 is an enlarged, left hand side elevation of some parts of the gravure printing section shown in FIG. 6.

As also shown in FIG. 8, the impression cylinder 38 is mounted fast on a shaft which has its opposite ends rotatably supported by a pair of bearing blocks 45 which are capable of sliding up and down along respective upstanding guide rails 46. Consequently, the impression cylinder 38 is itself also movable up and down with respect to the plate cylinder 37. For such vertical displacement of the impression cylinder 38 over a relatively long stroke, a pair of air cylinders C1 are mounted to a support 48 bridging the top ends of the guide rails 46. The piston rods 50 depending from the air cylinders C1 are coupled to the respective bearing blocks 45. The air cylinders C1 are to be contracted, as at the time of the change of the plate cylinder 37, for raising the impression cylinder 38 to the position indicated at 38' in FIG. 7.

Another pair of air cylinders C2 have their head ends pin-joined at 52 to the guide rails 46. The depending piston rod 53 of each air cylinder C2 is also pinned at 54 to one end of a lever 55. Medially pivoted on a fixed pin 56, each lever 55 rotatably carries a roller 57 on its other end. The rollers 57 on the pair of levers 55 make rolling engagement with the undersides of the respective bearing blocks 45. Accordingly, upon extension of the cylinders C2, the levers 55 will pivot in a clockwise direction, as viewed in FIG. 7, thereby lifting the bearing blocks 45 and impression cylinder 38 away from the plate cylinder 37.

As is conventional with usual gravure printing presses, the web S is threaded over the guide roll 31, then between plate cylinder 37 and impression cylinder 38, and then under the guide roll 32 to be directed upwardly.

FIG. 8 indicates that an appropriate drive mechanism M is coupled to the plate cylinder 37 for imparting rotation thereto. For printing, not only must the plate cylinder 37 be rotated, and the web S fed to the printing unit 30, but also the impression cylinder 38 must be lowered to engage the web between itself and the plate cylinder 37. Thus the pair of air cylinders C2 may be contracted for lowering the impression cylinder 38 and hence for setting the printing unit 30 into operation as required.

With reference back to FIG. 6 a printing drier 60 is provided adjacent the upward path of the web S from the printing unit 30. The drier 60 is provided with a fan 61 mounted atop the framework 29, an air heater 62, and a duct 63 for conveying to the drier 60 the stream of air that has been created by the fan 61 and subsequently heated by the heater 62.

Figure 9:
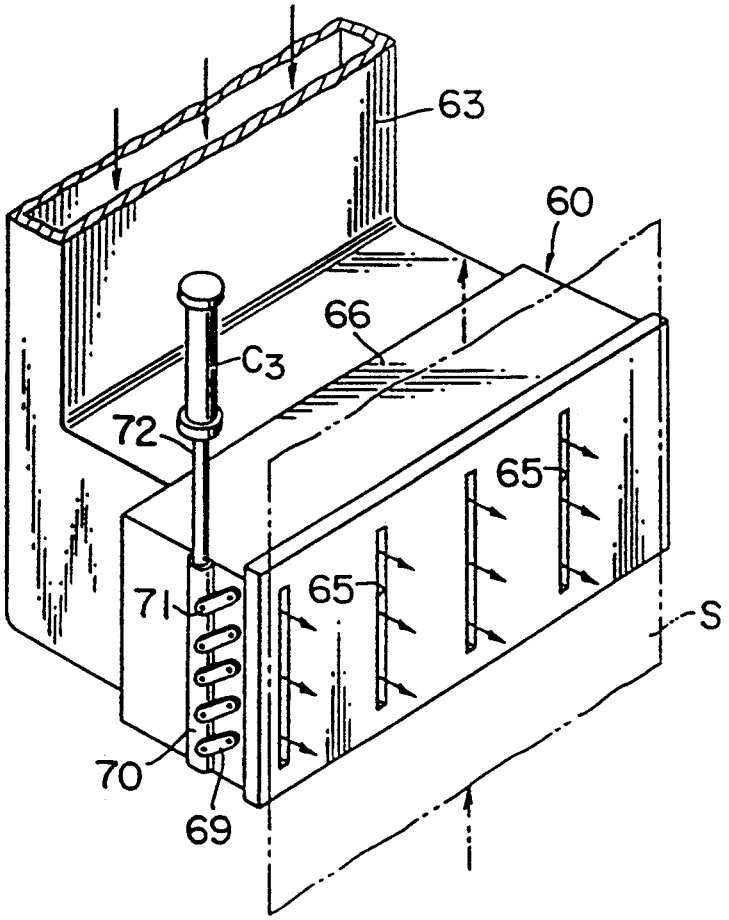
FIG. 9 is an enlarged perspective view of the drier provided in the gravure printing section of the apparatus of FIG. 5.
Figure 10:
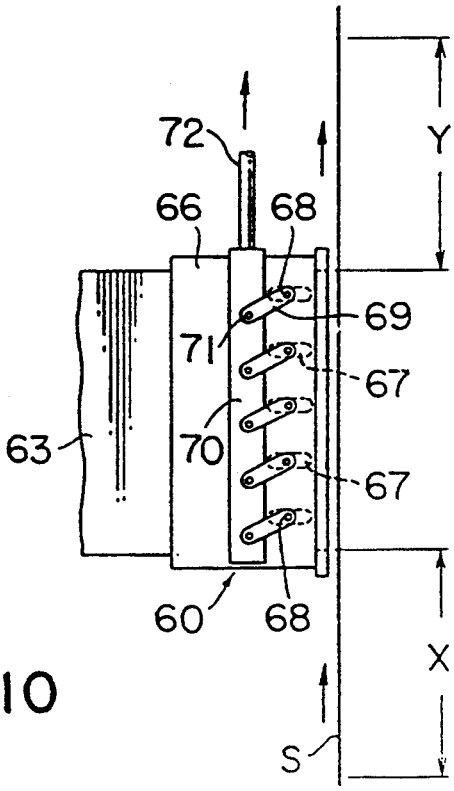
FIG. 10 is a fragmentary side elevation of the drier of FIG. 9.

The detailed construction of the printing drier 60 will become apparent from a study of FIGS. 9 and 10. Extending from the air heater 62, the duct 63 terminates in a boxlike outlet enclosure 66 having a plurality of air outlet slots 65 cut in its front face directed toward the web S. Each extending along the path of the web S, the outlet slots 65 are equal in number to the individual strips of recording sheet 1 into which the web S is to be subsequently slit. Disposed within the outlet enclosure 66 and just interiorly of the outlet slots 65 are shutters 67 pivotally supported by respective rotatable shafts 68. These shafts are each coupled to one end of a link 69, the other end of which is pivoted at 71 to a common actuating bar 70. An upstanding air cylinder C3 has its piston rod 72 coupled to the actuating bar 70. Therefore, as the actuating bar 70 is raised from its FIG. 10 position by the air cylinder C3, the shutters 67 will close the outlet slots 65. The heated air will issue from the outlet slots 65 only when the cylinder C3 is extended to open the shutters 67. The outlet slots 65 are disposed respectively along the paths of the end marks that have been printed on the web S in side by side relation in its transverse direction by the printing unit 30, for drying the end marks immediately after their printing.

After having the end marks printed thereon and subsequently dried in the printing section 16, the web S is directed by guide rolls 75 into the slitting section 17. Being itself of known construction, the slitting section 17 will be described briefly. The web S travels from the guide rolls 75 to additional guide rolls 76 and 77 and then to a master roll 78. Then, as illustrated on an enlarged scale in FIG. 11, the web S passes over a guide roll 79 on to a pair of slitter rolls 80*a* and 80*b*. The slitter roll 80*a* rotates about a fixed axis whereas the other slitter roll 80*b* is rotatably mounted to an arm 81 pivotable about an pin or shaft 82. The fixed-axis slitter roll 80*a*, for example, is conventionally provided with annular slitting blades. The strips of recording sheet created by slitting the web S are directed away from the slitting section 17 via either of two dividing rolls 83*a* and 83*b* to be wound into the rolls 26 of the recording sheet winding section 18.

Figure 11:
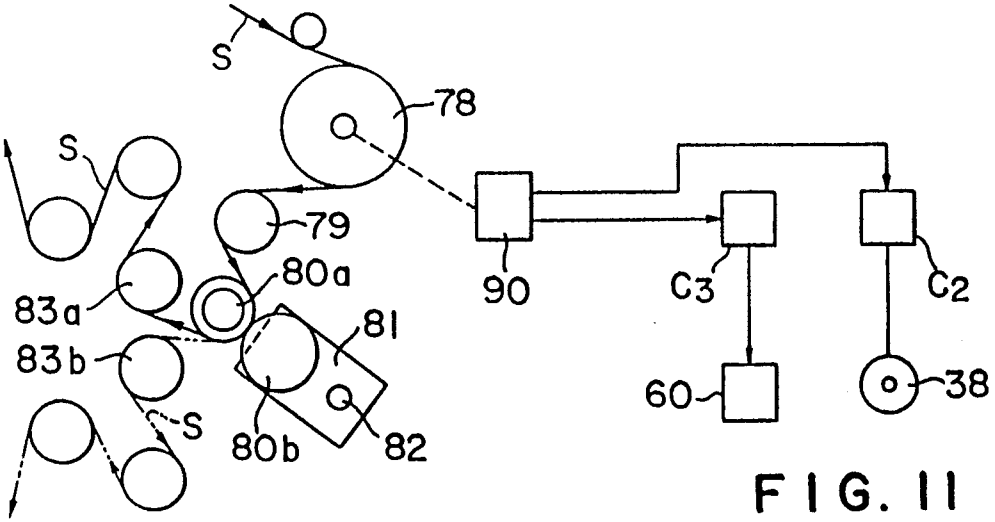
FIG. 11 is an enlarged diagrammatic representation of the slitting section included in the apparatus of FIG. 5.

As seen in both FIGS. 5 and 11, the master roll 78 is provided with a revolution sensor circuit 90 for sensing each revolution of the master roll and, in consequence, the length of the printed web S that has been fed. The sensor circuit 90 is further constructed to count the pulses representative of the revolutions of the master roll 78. When the pulses are counted up to a preset number indicative of a desired position on the web S where the printing of the end marks are to be started, the pair of air cylinders C2 are contracted thereby permitting the impression cylinder 38, which has been lifted away from the plate cylinder 37, to be lowered to engage the web S between plate cylinder and impression cylinder. The printing of the end marks is now started on the web S.

The revolution sensor circuit 90 can also detect the fact that each group of printed end marks have been fed to the drier 60, whereupon the air cylinder C3 will be extended to open the shutters 67 and so to permit the drier to apply the heated air through the outlet slots 65 to the end marks. The application of the heated air will be instantly suspended when the group of end marks travels past the outlet slots 65, as then the air cylinder C3 will be contracted under the control of the revolution sensor circuit 90. As indicated in FIG. 10, the shutters 67 may be opened when the leading ends of each group of end marks come to a position spaced a preassigned distance X upstream from the outlet slots 65, and may be closed when the trailing ends of the end marks reach a position spaced a preassigned distance Y downstream from the outlet slots, both under the control of the revolution sensor circuit 90.

In the operation of the apparatus constructed as in the foregoing, the broad web S that has been unwound from its roll 20 is cut into the required lengths, and leader tapes are spliced to their ends, in the splicing section 15. Then, in the gravure printing section 16, a group of end marks are printed in prescribed positions on each length of the web S by the printing unit 30, and only the end marks are dried by the drier 60 without adversely affecting the other part of the web. Then, in the slitting section 17, each length of the printed web is slit longitudinally into a plurality of thermal transfer type recording strips of the required width. These strips are then wound into the rolls 26. Each roll has a leader tape joined to its outer end.

As has been set forth in connection with FIG. 2, the end mark 3 may be formed either directly on one side of the base film 1*a* or on the hot-melt ink layer 1*b* on the other side of the base film. The end marks may be printed on either side of the web S depending upon whether the web is threaded along the path indicated by the solid line in FIG. 6 or, as represented by the phantom line designated S' in the same figure, over successive additional guide rolls 92, 93 and 94, then over the noted guide roll 32, then between plate cylinder 37 and impression cylinder 38, and then over the guide roll 31. The drier 60 may be held out of operation when the web is threaded along the alternative path S'; instead, another similar drier 60' may be used for drying the printed end marks on the web S.

Although the invention has been described hereinbefore in terms of some preferable embodiments thereof, it is understood that various modifications may be made in such embodiments without departing from the scope of the invention. For example, an infrared heater or heaters or other types of heat radiators may be employed for drying the printed end marks on the web. Such driers or heaters may further be adapted to dry only those parts of the end marks which need immediate drying. Still further, the temperatures of the heated airstreams issuing from the outlet slots may be individually controlled for each slot. As required, moreover, the heater 62 may be energized at a preset moment preceding the commencement of printing, in order that sufficient heat energy may be available at the time of drying.

As an additional possible modification, the plate cylinder may be heated during the printing of the end marks for the higher quality of the printings. It is also understood that the drier or driers will be unnecessary if the ink contains no conventional solvent but is composed of a pigment and a binder.

Among the advantages gained by the apparatus for the manufacture of the thermal transfer type recording sheet in accordance with the invention is the fact that it can effectuate both the printing of the end marks and, substantially concurrently therewith, the slitting of the web into the individual strips of recording sheet. The recording sheet with the end marks thereon can thus be manufactured more efficiently than by the conventional practice of forming off-line the end marks on the web. As a further advantage, even if wrinkles or other defects develop during slitting, only the defective parts of the sheet may be removed thereby minimizing the waste of the sheet materials.

INDUSTRIAL APPLICABILITY

The invention is best suited for application to thermal transfer type recording sheets and to their manufacture but may be applied to other types of sheets requiring end marks and to their manufacture as well.

We claim:

1. A method of manufacturing strips of thermal transfer-type recording sheets, comprising the steps of:

supplying continuously a web of base film having a hot-melt ink layer on one surface thereof;

continuously feeding said web with a leading end thereof ahead along a path;

printing end marks by gravure printing process on either side of said web being fed along said path, at intervals in a direction transverse to the direction of feed of said web and only within regions of the web which are adjacent to said leading end and have a length in the direction of feed of the web; and slitting said web in said direction of feed to separate the web into a plurality of narrow strips of recording sheet having said end marks printed respectively on the narrow strips of recording sheet having said end marks printed respectively on the narrow strips.

2. The method of claim 1, further comprising the step of:

drying only said regions of the web after the step of printing the end marks.

3. The method of claim 2, wherein said drying step is carried out by applying streams of heated air to said regions.

4. The method of claim 1, further comprising the step of:

rolling up said narrow strips of recording sheet on roll shafts to form rolls of the strip, respectively, with the leading ends having the end marks at innermost positions of the respective rolls thus formed.

5. The method of claim 1, further comprising the steps of:

detecting a length of feed of the web from said leading end; and initiating said step of printing, responsive to the detection of the length.

6. The method of claim 3, further comprising the steps of:

detecting a length of feed of the web from said leading end; and initiating said drying step of applying streams of heated air to regions including the end marks with respect to said direction of feed, responsive to the detection of the length.

* * * * *